US005565086A

United States Patent [19]

Cody et al.

[11] Patent Number: 5,565,086

[45] Date of Patent: Oct. 15, 1996

[54] CATALYST COMBINATION FOR IMPROVED WAX ISOMERIZATION

[75] Inventors: Ian A. Cody, Clearwater; Alberto Ravella, Sarnia, both of Canada

[73] Assignee: Exxon Research and Engineering Company, Florham Park, N.J.

[21] Appl. No.: 332,988

[22] Filed: Nov. 1, 1994

[51] Int. Cl.[6] ..... C10G 73/38

[52] U.S. Cl. ..... 208/27; 208/64; 208/65; 208/134; 208/135; 208/137; 208/138; 208/139

[58] Field of Search ..... 208/64, 65, 27, 208/134, 135, 137, 138, 139

[56] References Cited

U.S. PATENT DOCUMENTS

| | | | |
|---|---|---|---|
| 3,223,617 | 12/1965 | Maziuk | 208/139 |
| 3,642,612 | 2/1972 | Girotti et al. | 208/89 |
| 4,443,326 | 4/1984 | Field | 208/64 |
| 4,498,973 | 2/1985 | Sikonia et al. | 208/64 |
| 4,554,065 | 11/1985 | Albinson et al. | 208/59 |
| 4,601,993 | 7/1986 | Chu et al. | 502/66 |
| 4,645,586 | 2/1987 | Buss | 208/64 |
| 4,900,707 | 2/1990 | Cody et al. | 502/230 |
| 4,906,601 | 3/1990 | Cody et al. | 502/230 |
| 4,919,786 | 4/1990 | Hamner et al. | 208/27 |
| 4,929,795 | 5/1990 | Cody et al. | 585/739 |
| 4,937,399 | 6/1990 | Wachter et al. | 585/749 |
| 4,943,672 | 7/1990 | Hamner et al. | 585/737 |
| 4,959,337 | 9/1990 | Cody et al. | 502/230 |
| 4,992,159 | 2/1991 | Cody et al. | 208/89 |
| 5,059,299 | 10/1991 | Cody et al. | 208/27 |
| 5,122,258 | 6/1992 | Eadie et al. | 208/112 |
| 5,158,671 | 10/1992 | Cody et al. | 208/264 |
| 5,182,248 | 1/1993 | Cody et al. | 502/230 |
| 5,200,382 | 4/1993 | Cody et al. | 502/204 |
| 5,254,518 | 10/1993 | Soled et al. | 502/241 |
| 5,292,427 | 3/1994 | McVicker et al. | 208/64 |

OTHER PUBLICATIONS

"New Molecular Sieve Process for Lube Dewaxing By Wax Isomerization" S. J. Miller, Microporous Materials 2 (1994) 439–449 (No Month).

"Hydride Transfer and Olefin Isomerization as Tools to Characterize Liquid and Solid Acids" McVicker et al, Acc Chem Res 19 1986, 78–84 (No Month).

*Primary Examiner*—Anthony Mc Farlan
*Assistant Examiner*—Walter D. Griffin
*Attorney, Agent, or Firm*—Joseph J. Allocca; James H. Takemoto

[57] ABSTRACT

The present invention is directed to an improved isomerization process employing a catalyst wherein the catalyst comprises a pair of catalyst particles of different acidity utilized either as distinct beds of such discrete particles or as a mixture of such discrete particles. The isomerization process utilizing such a catalyst produces a product which exhibits higher VI as compared to products produced using either catalyst component separately or using a single catalyst having the average acidity of the two discrete catalysts.

7 Claims, No Drawings

CATALYST COMBINATION FOR IMPROVED WAX ISOMERIZATION

BACKGROUND OF THE INVENTION

1. Field of the Invention

This invention relates to the hydroisomerization of wax and/or waxy feeds such as waxy distillates or waxy raffinate using a combination of catalysts to produce lube basestocks of increased viscosity index and/or improved volatility.

2. Description of the Related Art

The isomerization of wax and waxy feeds to liquid products boiling in the lube oil boiling range and catalysts useful in such practice are well known in the literature. Preferred catalysts in general comprise noble Group VIII metal on halogenated refractory metal oxide support, e.g. platinum on fluorided alumina. Other useful catalysts can include noble Group VIII metals on refractory metal crude support such as silica/alumina which has their acidity controlled by use of dopants such as yttria. Isomerization processes utilizing various catalysts are disclosed and claimed in numerous patents, see U.S. Pat. No. 5,059,299; U.S. Pat. No. 5,158,671; U.S. Pat. No. 4,906,601; U.S. Pat. No. 4,959,337; U.S. Pat. No. 4,929,795; U.S. Pat. No. 4,900,707; U.S. Pat. No. 4,937,399; U.S. Pat. No. 4,919,786; U.S. Pat. No. 5,182,248; U.S. Pat. No. 4,943,672; U.S. Pat. No. 5,200,382; U.S. Pat. No. 4,992,159. The search for new and different catalysts or catalyst systems which exhibit improved activity, selectivity or longevity, however, is a continuous ongoing exercise.

DESCRIPTION OF THE INVENTION

The present invention is directed to a process for hydroisomerizing wax containing feeds such as wax, e.g., slack wax or Fischer-Tropsch wax, and/or waxy distillates or waxy raffinates, using two catalysts having acidity in the range 0.3 to 2.3 (as determined by the McVicker-Kramer technique described below), wherein the catalyst pairs have acidity, differing by 0.1 to about 0.9 units, preferably an about 0.2 to about 0.6 units, said catalyst pair being employed either as distinct beds of such particles in a hydroisomerization reaction zone or as a homogeneous mixture of discrete particles of each catalyst.

In determining the acidity of each group of discrete particles constituting separate catalyst components of the pair of catalysts used it is preferred that the acidity exhibited and reported be that of each particle of the particular catalyst component per se and not an average of a blend of particles of widely varying acidity. Thus, the acidity of one group of particles of the pair should be the intrinsic actual acidity of all the particles of the group measured, not an average based on wide individual fluctuation. Similarly, for the other group of particles of the pair, the acidity reported should be that representative of all the particles constituting the group and not an average of widely fluctuating acidities within the group.

The acidity of the catalysts is determined by the method described in "Hydride Transfer and Olefin Isomerization as Tools to Characterize Liquid and Solid Acids", McVicker and Kramer, Acc Chem Res 19, 1986 pg. 78–84.

This method measures the ability of catalytic material(s) to convert 2 methylpent-2-ene into 3 methylpent-2-ene and 4 methylpent-2-ene.

More acidic materials will produce more 3-methylpent-2-ene (associated with structural re-arrangement of a carbon atom). The ratio of 3 methylpent-2-ene to 4-methylpent-2-ene formed at 200° C. is a converted measure of acidity. For the purposes of this invention, catalysts with high acidity are defined as those with ratios of 1.1 to 2.3 while low acidity catalysts have ratios from 0.3 to 1.1.

Catalysts from either the low or high acidity group can comprise, for example, a porous refractory metal oxide support such as alumina, silica-alumina, titania, zirconia, etc. or any natural or synthetic zeolite such as offretite, zeolite X, zeolite Y, ZSM-5, ZSM-22 etc. which contain an additional catalytic component selected from the group consisting of Group VI B, Group VII B, Group VIII metal and mixtures thereof, preferably Group VIII metal, more preferably noble Group VIII metal, most preferably platinum and palladium present in an amount in the range of 0.1 to 5 wt %, preferably 0.1 to 2 wt % most preferably 0.3 to I wt % and which also may contain promoters and/or dopants selected from the group consisting of halogen, phosphorous, boron, yttria, rare-earth oxides and magnesia preferably halogen, yttria, magnesia, most preferably fluorine, yttria, magnesia. When halogen is used it is present in an amount in the range 0.1 to 10 wt %, preferably 0.1 to 5 wt %, more preferably 0.1 to 2 wt % most preferably 0. 5 to 1.5 wt %.

For those catalysts which do not exhibit or demonstrate acidity, for example gamma-alumina, acidity can be imparted to the catalyst by use of promoters such as fluorine, which are known to impart acidity, according to techniques well known in the art. Thus, the acidity of a platinum on alumina catalyst can be very closely adjusted by controlling the amount of fluorine incorporated into the catalyst. Similarly, the catalyst particles can also comprise materials such as catalytic metal incorporated onto silica alumina. The acidity of such a catalyst can be adjusted by careful control of the amount of silica incorporated into the silica-alumina base or by starting with a high acidity silica-alumina catalyst and reducing its acidity using mildly basic dopants such as yttria or magnesia, as taught in U.S. Pat. No. 5,254,518 (Soled, McVicker, Gates and Miseo).

For a number of catalysts the acidity, as determined by the McVicker/Kramer method, i.e., the ability to convert 2 methylpent-2-ene into 3 methylpent-2-ene and 4 methylpent-2-ene at 200° C., 2.4 w/h/w, 1.0 hour on feed wherein acidity is reported in terms of the mole ratio of 3 methylpent-2-ene to 4-methylpent-2-ene, has been correlated to the fluorine content of platinum loaded fluorided alumina catalyst and to the yttria content of platinum loaded yttria doped silica/alumina catalysts. This information is reported below.

Acidity of 0.3% Pt on fluorided alumina at different fluoride levels:

| F Content (%) | Acidity (McVicker/Kramer) |
|---|---|
| 0.5 | 0.5 |
| 0.75 | 0.7 |
| 1.0 | 1.5 |
| 1.5 | 2.5 |
| 0.83 | 1.2 (interpolated) |

Acidity of 0.3% Pt in yttria doped silica/alumina naturally comprising 25 wt % silica.

| Yttria Content (%) | Acidity (McVicker/Kramer) |
|---|---|
| 4.0 | 0.85 |
| 9.0 | 0.7 |

While the specific components and compositional make-up of the catalyst can vary widely, it is important for practice of the present invention that the catalyst used be distinguishable in terms of their acidity. Thus there should be an about 0.1 to about 0.9 mole ratio unit difference between the pair of catalysts, preferably an about 0.2 to about 0.6 mole ratio unit difference between the catalyst pair.

In practicing the hydroisomerization step, the ratio of the high acidity catalyst to the low acidity catalyst in the pair used is in the range 1:10 to 10:1, preferably 1:3 to 3:1, more preferably 2:1 to 1:2.

In practicing this invention the feed to be isomerized can be any wax or wax containing feed such as slack wax, which is the wax recovered from a petroleum hydrocarbon by either solvent or propane dewaxing and can contain entrained oil in an amount varying up to about 50%, preferably 35% oil, more preferably 25% oil, Fischer-Tropsch wax, which is a synthetic wax produced by the catalyzed reaction of CO and $H_2$. Other waxy feeds such as waxy distillates and waxy raffinates can also be used as feeds.

Waxy feeds secured from natural petroleum sources contain quantities of sulfur and nitrogen compounds which are known to deactivate wax hydroisomerization catalyst.

To prevent this deactivation it is preferred that the feed contain no more than 10 ppm sulfur, preferably less than 2 ppm, and no more than 2 ppm nitrogen, preferably less than 1 ppm.

To achieve these limits the feed is preferably hydrotreated to reduce the sulfur and nitrogen content.

Hydrotreating can be conducted using any typical hydrotreating catalyst such as Ni/Mo on alumina, Co/Mo on alumina, Co/Ni/Mo on alumina, e.g., KF-840, KF-843, HDN-30, Criterion C-411 etc. It is preferred that bulk metal catalysts such as Ni/Mn/Mo sulfide or Co/Ni/Mo sulfide as described in U.S. Pat. No. 5,122,258 be used.

Hydrotreating is performed at temperatures in the range of 280° to 400° C., preferably 340° to 380° C., at pressures in the range of 500 to 3000 psi, preferably 1000 to 2000 psi, and at a hydrogen treat gas rate of 500 to 5000 scf/bbl.

The isomerization process employing the catalyst system is practiced at a temperature in the range of 270° to 400° C., preferably 330° to 360° C., a pressure in the range of 500 to 3000 psi, preferably 1000 to 1500 psi, a hydrogen treat gas rate of 1000 to 10,000 SCF/bbl, preferably 1000 to 3000 SCF/bbl and a flow velocity of 0.1 to 10 LHSV, preferably 0.5 to 2 LHSV. When using a catalyst pair wherein one component is at the low acidity end of the acidity scale (e.g. 0.5) it is necessary to employ more severe isomerization conditions within the above recited ranges. Conversely, when the low acidity component is near the higher end of its scale range (e.g. about 1.1), less severe isomerization conditions within the recited ranges can be employed. In general, it is desirable to perform wax isomerization under less severe conditions since operation under those conditions results in a product of superior stability. Thus, when employing about 1000 psi, a temperature no higher than about 360° C. is preferable to achieve high yields of desirable, stable product.

In both the hydrotreating and hydroisomerization steps, the hydrogen used can be either pure or plant hydrogen (≈50–100% $H_2$).

Following isomerization the total liquid product is fractionated into a lubes cut and a fuels cut, the lubes cut being identified as that fraction boiling in the 330° C.+ range, preferably the 370° C.+ range or even higher. This lubes fraction is then dewaxed to a pour point of about −21° C. or lower. Dewaxing is accomplished by techniques which permit the recovery of unconverted wax, since in the process of the present invention this unconverted wax is recycled to the isomerization unit. It is preferred that this recycle wax be recycled to the main wax reservoir and be passed through the hydrotreating unit to remove any quantities of entrained dewaxing solvent which could be detrimental to the isomerization catalyst.

Solvent dewaxing is utilized and employs typical dewaxing solvents. Solvent dewaxing utilizes typical dewaxing solvents such as $C_3$–$C_6$ ketones (e.g. methyl ethyl ketone, methyl isobutyl ketone and mixtures thereof), $C_6$–$C_{10}$ aromatic hydrocarbons (e.g. toluene) mixtures of ketones and aromatics (e.g. MEK/-toluene), auto-refrigerative solvents such as liquified, normally gaseous $C_2$–$C_4$ hydrocarbons such as propane, propylene, butane, butylene and mixtures thereof, etc. at filter temperatures of −25° C. to −30° C. The preferred solvent to dewax the isomerate, especially isomerates derived from the heavier waxes (e.g. bright stock waxes) under miscible conditions, and thereby produce the highest yield of dewaxed oil at a high filter rate, is a mixture of MEK/MIBK (20/80 v/v) used at a temperature in the range −25° C. to −30° C. Pour points lower than −21° C. can be achieved using lower filter temperatures and other ratios of said solvents but a penalty is paid because the solvent-feed systems become immiscible, causing lower dewaxed oil yields and lower filter rates.

It has been found that the total liquid product (TLP) from the isomerization unit can be advantageously treated in a second stage at mild conditions using the isomerization catalyst or simply a noble Group VIII metal on refractory metal oxide catalyst to reduce PNA and other contaminants in the isomerate and thus yield an oil of improved daylight stability. This aspect is the subject of U.S. Pat. No. 5,158,671. The total isomerate is passed over a charge of the isomerization catalyst or over just noble Gp VIII on e.g. transition alumina. Mild conditions are used, e.g. a temperature in the range of about 170°–270° C., preferably about 180° to 220° C., at pressures of about 300 to 1500 psi $H_2$, preferably 500 to 1000 psi $H_2$, a hydrogen gas rate of about 500 to 10,000 SCF/bbl, preferably 1000 to 5000 SCF/bbl and a flow velocity of about 0.25 to 10 v/v/hr, preferably about 1–4 v/v/hr. Temperatures at the high end of the range should be employed only when similarly employing pressures at the high end of their recited range. Temperatures in excess of those recited may be employed if pressures in excess of 1500 psi are used, but such high pressures may not be practical or economical.

The total isomerate can be treated under these mild conditions in a separate, dedicated unit or the TLP from the isomerization reactor can be stored in tankage and subsequently passed through the aforementioned isomerization reactor under said mild conditions. It has been found to be unnecessary to fractionate the 1st stage product prior to this mild 2nd stage treatment. Subjecting the whole product to this mild second stage treatment produces an oil product which upon subsequent fractionation and dewaxing yields a base oil exhibiting a high level of daylight stability and oxidation stability. These base oils can be subjected to subsequent hydrofinishing using conventional catalysts such as KF-840 or HDN-30 (e.g. Co/Mo or Ni/Mo on alumina) at conventional conditions to remove undesirable process impurities to further improve product quality.

EXAMPLES

Background - 1.

A catalyst (Catalyst A) comprising 0.3% platinum on 9.0 wt % yttria doped silica-alumina (silica content of the original silica-alumina was 25%) was evaluated for the conversion of a 600N raffinate which contained 23.7% wax. The waxy raffinate feed was hydrotreated using KF-840 at 360° C., 1000 psi $H_2$ 1500 SCF/bbl and 0.7 v/v/hr.

The hydrotreated feed was then contacted with the yttria doped silica/alumina catalyst at 370° C., 1.0 LHSV (v/v/h), a treat gas rate of 2500 SCF H2/bbl and a pressure of 1000 psig. Following such treatment the product was analyzed and it was found that it contained 26.9% wax, indicating that Catalyst A had no appreciable capability to affect wax disappearance, i.e. has no hydroisomerization activity. While the viscosity index of the dewaxed oil product increased to 105, compared to a VI of 91.6 for dewaxed feed, this VI increase is attributed to naphthenic ring opening and not selective wax isomerization.

Background - 2.

A catalyst (Catalyst B) comprising 0.3% Pt on 0.5% $F/Al_2O_3$ catalyst was similarly evaluated for the conversion of a 600N raffinate. The raffinate had 34.6% wax on a dry basis. The feed was hydrotreated over KF-840 at 375° C., 1000 PSi $H_2$ pressure, 1500 $SCFH_2$/bbl, and 0.7 LHSV. The hydrotreated feed was contacted with the 0.5% F catalyst under various conditions reported below.

| Isomerization Condition | | | 370° C.+ | DWO |
|---|---|---|---|---|
| Temp °C. | Isom LHSV (v/v/hr) | 370° C.– wt % | Residual Wax Content, wt % | Viscosity Index |
| 340 | 0.5 | 14.0 | 33.8 | 114 |
| 345 | 0.5 | 15.6 | 31.7 | 114 |
| 352 | 0.5 | 19.1 | 23.1 | 116 |
| 382 | 1.5 | 24.7 | 27.8 | 121 |
| 390 | 1.5 | 29.5 | 15.0 | 122 |

Comparing the results of Background Examples 1 and 2, it is seen that whereas the yttria doped catalyst (Catalyst A) was not selective for wax conversion, the 0.5% F catalyst (Catalyst B) did convert wax selectively at more severe conditions as evidenced by reduction in wax content and increase in VI.

Background - 3.

Catalyst B was evaluated for the conversion of a 600N slack wax containing 17% oil in wax. The slack wax was hydrotreated over KF840 catalyst at 2 different temperatures then the hydrotreated wax feed was contacted with Catalyst B at a number of different temperatures. The results are reported below for conversions in the range of 10 to 20% 370° C–.

Hydrotreater conditions were a pressure of 1000 psig, 0.7 LHSV and 1500 SCF/bbl.

| Hydro- | Isomerization | | DWO Product Properties | | |
|---|---|---|---|---|---|
| treater | Condition* | | Viscosity | 370° C.+ | |
| Tempera-ture, °C. | Temp °C. | LHSV v/v/hr | @ 100° C., cSt | residual wax Content, wt % | VI |
| 340 | 362 | 1.5 | 6.707 | 59.0 | 145.0 |
| 340 | 372 | 1.5 | 6.399 | 46.8 | 146.2 |
| 340 | 388 | 1.5 | 5.747 | 20.7 | 144.5 |
| 340 | 382 | 1.5 | 5.986 | 29.5 | 145.5 |
| 370 | 382 | 1.5 | 5.767 | 21.2 | 145.1 |

*other conditions 1000 PSI $H_2$, 2500 SCF/bbl

Comparing Background Examples 1, 2 and 3, it is seen that Catalyst B achieves selective wax conversion on both the 600N raffinate and slack wax although product stability was poor because of the high temperatures required (>360° C. at 1000 psi) during isomerization. It therefore is fair to say that any catalyst which performs well on one feed will perform equally well on other feeds. Conversely, if a catalyst performed poorly on one feed, e.g., raffinate, it would be expected to perform poorly on others (e.g., wax). Using this logic, therefore one would expect yttria doped catalyst to have little if any effect on a slack wax feed since it had no appreciable effect on the wax present in a raffinate.

Background - 4

A 0.3% Pt on 1% F/A1203 catalyst (catalyst C) was evaluated for performance on a 600N slack wax feed. The 600N slack wax feed containing 83% wax (17% oil) was hydrotreated over KF840 while a 600N slack wax feed sample containing 77% wax (23% oil) was hydrotreated over a bulk metal catalyst comprising Ni, Mn, and Mo sulfide (see U.S. Pat. No. 5,122,258).

The hydrotreated wax was then contacted with Catalyst C under a number of different conditions. The results are presented below for conversion in the range 15 to 20% 370° C–.

| (a) feed wax content 83% | | | | | | | |
|---|---|---|---|---|---|---|---|
| | | | | | Dewaxed Oil Properties | | |
| Hydro- | Hydro- | Isomerization Condition | | | 370° C.+ Residual | Vis | |
| treating Cat | treating Temp °C. | Temp, °C. | LHSV v/v/hr | Pressure Psi $H_2$ | Wax Content wt % | @ 100°C., cSt | VI |
| KF-840 | 340 | 352 | 1.5 | 1000 | 41.1 | 6.026 | 140.7 |
| KF-840 | 360 | 352 | 1.5 | 1000 | 38.5 | 5.897 | 141.4 |
| KF-840 | 370 | 352 | 1.5 | 1000 | 37.1 | 5.798 | 143.2 |

-continued (b) feed wax content 77%

| Hydro-treating Cat | Hydro-treating Temp °C. | Isomerization Condition LHSV | Temp, °C. | LHSV | Pressure Psig | Dewaxed Oil Properties 370° C.+ Residual Wax Content wt % | Vis @ 100° C., cSt | VI |
|---|---|---|---|---|---|---|---|---|
| Bulk | 340 | 0.7 | 358 | 1.5 | 1000 | 40.1 | 6.136 | 138.0 |
| Bulk | 355 | 0.7 | 360 | 1.5 | 1000 | 38.1 | 5.897 | 140.0 |
| Bulk | 370 | 0.7 | 360 | 1.5 | 1000 | 36.6 | 5.760 | 141.0 |

As expected, the higher VI product was produced from the feed which had the higher wax content.

Comparing these results with background Example 3 (Catalyst B) shows that isomerization of wax using a higher fluorine content catalyst (Catalyst C) can be achieved at lower temperatures but results in a lower VI product for about the same residual wax content. An important advantage, however, of Catalyst C (high fluorine content) over Catalyst B (low fluorine content) is that the product can be subsequently stabilized by the procedure described in U.S. Pat. No. 5,158,671, i.e. second stage mild condition treatment using isomerization catalyst or simply noble Group VIII metal on refractory metal oxide support catalyst.

Background - 5

A sample of 600N slack wax containing 78% wax (22% oil) was hydrotreated over KF-840 catalyst at a number of different temperature conditions. Other hydrotreater conditions were a pressure of 1000 psig, 0.7 LHSV, and a treat gas rate of 1500 SCF/bbl. This hydrotreated slack wax was then contacted for isomerization with a dual catalyst system comprising discrete beds (in a single reactor) of B and C catalysts in a 1 to 2 ratio. The feed contacted the B catalyst first. The isomerization conditions were uniform across the reactor for each run performed. The results are reported below.

At 15 to 20% 370° C–. conversion, product VI ranged from about 138 to 141 depending on the conditions used. This is similar to the results obtained using Catalyst C by itself and about as good as using Catalyst B by itself. This example indicates the maximum acidity difference which can exist between catalyst pairs when using a catalyst pair, i.e., the difference in the acidity between the low acidity catalyst and the high acidity catalyst as determined by the ratio of 3 methypent-2-ene to 4-methylpent-2-ene must be 0.9 units or less, preferably between 0.1 to 0.9 units.

| Hydro-treater Temp, °C. | Isomerization Condition* Temp, °C. | LHSV (v/v/h) | Dewaxed Oil Properties 370° C.+ Residual Wax Content, wt % | VIS @ 100° C., cSt | VI |
|---|---|---|---|---|---|
| 350 | 340 | 0.9 | 37.0 | 5.819 | 140.2 |
| 350 | 345 | 0.9 | 30.9 | 5.787 | 140.9 |
| 350 | 345 | 0.9 | 30.4 | 5.789 | 138.1 |
| 370 | 336 | 0.9 | 45.6 | 5.996 | 140.2 |
| 370 | 340 | 0.9 | 39.7 | 5.854 | 141.6 |

*Other conditions were a pressure of 1000 psig, and a treat gas rate of 2500 SCF/bbl.

EXAMPLE 1

A sample of 600N slack wax containing 77% wax (23% oil) was hydrotreated over a bulk NiMnMoS catalyst described in U.S. Pat. No. 5,122,258 at a series of different temperatures, a pressure of 1000 psig, a hydrogen treat gas rate of 1500 SCF/bbl and a 0.7 LHSV.

The hydrotreated slack wax was then hydroisomerized over two different catalysts; the first system comprised catalyst C alone. Catalyst C is described as a high acidity material with a 3 methylpent-2-ene to 4-methylpent-2-ene mole ratio of about 1.5.

The second catalyst system comprised a combination of catalyst C and catalyst A. Catalyst A is described as a low acidity catalyst (3 methylpent-2-ene to 4 methylpent-2-ene mole ratio of 0.7). In this system 2 parts of A were matched with 1 part of C in a stacked bed arrangement. The reactor beds were configured such that Catalyst A, the low acidity catalyst was first to contact feed (although this is not a necessary, essential or critical feature of the invention).

The results are presented in Table 1 and indicate that a product is made with higher VI than is achievable by using Catalyst C alone and at conditions which still yield a stable product. The results are surprising in view of the fact that Catalyst A has itself no recognized isomerization activity (see background example 1).

TABLE 1

| Hydro-treating Temp °C. | Isom Cat | Isomerization Condition* Temp °C. | LHSV v/v/hr | Dewaxed Oil Properties 370° C.+ Residual Wax Content, wt % | Vis @ 100, cSt | VI |
|---|---|---|---|---|---|---|
| 340 | C | 358 | 1.5 | 40.1 | 6.14 | 138 |
| 355 | C | 360 | 1.5 | 38.1 | 5.89 | 140 |
| 370 | C | 360 | 1.5 | 36.6 | 5.76 | 141 |
| 355 | 1A:2C | 357 | 1.0 | 34.8 | 5.65 | 142.2 |
| 355 | 1A:2C | 360 | 1.5 | 36.2 | 5.77 | 141.8 |

*Other conditions pressure 1000 Psi $H_2$, treat rate 2500 SCF/bbl

EXAMPLE 2

This example illustrates that the advantage demonstrated in Example 1 arises from pairing of catalysts of two different acidities. No such advantage is observed by using a single catalyst of the same arithmetic average acidity as the pair. Catalyst D, comprising 0.83% F or Pt/alumina has an (interpolated) acidity of 1.1, similar to the arithmetic average of the catalyst pair of Example 1, one third of Catalyst A and two thirds of Catalyst C (i.e., $0.7\times\frac{1}{3}+1.5\times\frac{2}{3}=1.2$ acidity average).

A sample of 600N slack wax 83% wax (17% oil) was hydrotreated over KF-840 cat at 350° C., 1000 $PSIH_2$ and treat gas rate of 150.0 SCF/bb. The hydrotreated wax then isomerized over Catalyst D.

The results are reported in Table 2.

Comparing the results of Table 2 with the results reported using Catalyst C in Background Example 4 it is seen that there is no appreciable difference between the products made using the 1%F Catalyst C and the 0.83%F Catalyst D.

TABLE 2

| HYDRO- | | ISOMERIZATION CONDITIONS | | | Dewaxed Oil Properties | | |
|---|---|---|---|---|---|---|---|
| TREATING CATALYST | ISOM CAT | TEMP °C. | LHSV v/v/h | 370° C.– CONVERSION | 370° C.+ RESIDUAL WAX CONTENT, wt % | VIS AT 100° C. cSt | VI |
| KF-840 | D | 357 | 1.5 | 19.7 | 25.7 | 5.73 | 140.0 |
| | D | 347 | 1.0 | 18.4 | 26.7 | 5.79 | 138.9 |

Comparing the results of Example 1 with the results of Example 2 it is seen that the multi component catalyst system produces a markedly different product exhibiting superior VI.

What is claimed is:

1. A method for the hydroisomerization of waxy feeds to produce lube basestocks having increased viscosity index which comprises contacting the waxy feeds with a catalyst under hydroisomerization conditions, said catalyst comprising a pair of discrete catalyst particles, said pair containing two types of discrete catalyst particles with a first low acidity type having an acidity of from about 0.3 to about 1.1 and a second high acidity type having an acidity of greater than about 1.1 to about 2.3, wherein said acidity is determined by the ability of each catalyst type to convert 2-methylpent-2-ene to 3-methylpent-2-ene and 4-methylpent- 2-ene and isexpressed as the mole ratio of 3-methylpent-2-ene to 4-methylpent-2-ene, and wherein the acidity of the first type of discrete catalyst particles differs from the acidity of the second type of discrete catalyst particles by about 0.1 to about 0.9 mole ratio units.

2. The method of claim 1 wherein there is an about 0.2 to about 0.6 mole ratio difference in the acidities of the pair of discrete catalyst particles used in the catalyst pair employed.

3. The method of claim 1 or 2 wherein the discrete particles of catalysts used in the catalyst pair are employed as discrete beds of particles.

4. The method of claim 1 or 2 wherein the discrete particles of catalysts used in the catalyst pair are employed as a mixture of such discrete particles.

5. The method of claim 1 or 2 wherein the ratio of the amount of low acidity catalyst to the amount of high acidity catalyst in the pair used is in the range 1:10 to 10:1.

6. The method of claim 5 wherein the ratio of each catalyst in the pair used is in the range 1:3 to 3:1.

7. The method of claim 6 wherein the ratio of each catalyst in the pair used is in the range 2:1 to 1:2.

* * * * *